US007275321B2

(12) United States Patent
Cheng

(10) Patent No.: US 7,275,321 B2
(45) Date of Patent: Oct. 2, 2007

(54) FOLDING KNIFE ASSEMBLY

(75) Inventor: Yang-Fu Cheng, Taipei (TW)

(73) Assignee: Kantas Products Co., Ltd. (TW)

( * ) Notice: Subject to any disclaimer, the term of this patent is extended or adjusted under 35 U.S.C. 154(b) by 0 days.

(21) Appl. No.: 11/366,429

(22) Filed: Mar. 3, 2006

(65) Prior Publication Data

US 2007/0204468 A1 Sep. 6, 2007

(51) Int. Cl.
*B26B 1/04* (2006.01)

(52) U.S. Cl. ..... 30/160; 30/158

(58) Field of Classification Search ..... 30/155, 30/158, 159, 160, 161
See application file for complete search history.

(56) References Cited

U.S. PATENT DOCUMENTS 4,811,486 A * 3/1989 Cunningham ..... 30/161
5,815,927 A * 10/1998 Collins ..... 30/161
6,308,420 B1 * 10/2001 Moser ..... 30/161
6,397,477 B1 * 6/2002 Collins ..... 30/161
6,651,344 B2 * 11/2003 Cheng ..... 30/159
6,810,588 B1 * 11/2004 Cheng ..... 30/153
7,080,457 B2 * 7/2006 Sullivan ..... 30/160
7,107,686 B2 * 9/2006 Linn et al. ..... 30/159
7,121,005 B2 * 10/2006 Hughes ..... 30/158

* cited by examiner

*Primary Examiner*—Hwei-Siu Payer
(74) *Attorney, Agent, or Firm*—Bacon & Thomas PLLC

(57) ABSTRACT

A folding knife assembly includes a knife handle, a knife body, and a brake portion, wherein the knife body can be turned into or out of the knife handle, and the brake portion is movably coupled to a pivotal position of the knife handle and the knife body. If the knife body is folded completely into the knife handle, an end of a resilient element will press precisely on the periphery of the brake portion, such that the resilient element produces a torque to turn the brake portion into the knife handle. If the knife body is turned gradually out from the knife handle, the resilient element will produce a torque to turn the knife body out from the knife handle, and the knife body will be popped out automatically from the knife handle, so as to effectively prevent the knife body from being popped out accidentally by vibrations.

14 Claims, 7 Drawing Sheets

FOLDING KNIFE ASSEMBLY

FIELD OF THE INVENTION

The present invention relates to a folding knife assembly, and more particularly to a folding knife assembly that can prevent its knife body from popping out unintentionally to avoid accidents or injuries to users.

BACKGROUND OF THE INVENTION

As science and technology advances day after day and people have increasingly high demand on living standard, different industries are developing more novel and advanced products to provide convenience to consumers, and such tendency is not limited to the area of high-tech products only, but also applied to the area of our daily products. With people's complaint about the inconvenience and design of a poor product, the convenience and performance of products are enhanced, and manufacturers tend to design their products with better quality and convenient functions, and one of the products is an automatic blade folding knife. Such product is not just popular and convenient to use, but is also suitable for outdoor leisure activities, and thus folding knives are quite welcome by people who like sports and leisure activities.

Referring to FIG. 1, an automatic blade knife 2 includes a hollow handle 20 and a knife body 21, wherein the hollow handle 20 has an opening disposed on a side of the hollow handle 20, and the knife body 21 is disposed inside the hollow handle 20 and has a blade portion 211 disposed at an appropriate position on a side of the knife body 21 and a pivotal portion 212 disposed at an end of the blade portion, and the pivotal portion 212 can be pivotally coupled to a spindle 22 disposed at an end of the hollow handle 20, and the hollow handle 20 has a resilient element 23 disposed therein and coupled to the knife body 21 and a press switch 24 disposed in the hollow handle 20 and on another side of the knife body 21 proximate to the spindle 22 for latching the knife body 21 and being protruded from the surface of the hollow handle 20, such that when a user presses the press switch 24 to release the latch of the knife body 21, the knife body 21 can be rotated about the spindle 22 by the resilience of the resilient element 23 and popped out quickly from the hollow handle 20. In other words, a user just needs one hand to quickly and easily operate the automatic blade knife 2.

However, the press switch 24 is protruded from a prominent position at the surface of the hollow handle 20 and thus the press switch 24 may be pressed unintentionally or played by children easily to trigger and pop out the knife body 21, and thus users or children may be cut accidentally and the original intention of the design becomes a danger to users. Although the resilient element 23 of the automatic blade knife 2 has strong resilience to quickly pop the knife body 21 out from the hollow handle 20, the knife body 21 of an automatic blade knife 2 placed in a user's pocket may be turned out of the hollow handle 20 suddenly by a slight external force, which may cut or stab at a user. Although automatic blade knives provide a convenient way of using a knife, they also cause tremendous dangers to users, which are incompliant to the requirements of strict safety regulations.

Therefore, each manufacturer designs various different knives based on the external look and the overall humanistic design or emphasizes on the multifunction and convenient operation of the knives, while paying much attention on the safety of using these knives. The design of knives not only shows a personal style, but also provides humanistic, multifunctional, and convenient features. The key factor for manufacturers to improve the market share of their products is to provide a simple and convenient design and maximize the safety protection, and thus finding a way of providing a convenient safe product that can meet the requirements of safety regulations becomes an important subject for knife manufacturers.

SUMMARY OF THE INVENTION

In view of the shortcomings of the prior art automatic blade knife that the knife body may be turned out from the hollow handle easily by touching its press switch accidentally and causes injuries to users, the inventor of the present invention based on years of experience in the related field to conduct extensive researches and experiments, and finally invented a folding knife assembly to overcome the shortcomings of the prior art.

Therefore, it is a primary objective of the present invention to provide a folding knife assembly that comprises a knife handle, a knife body, and a brake portion, wherein an end of a resilient element installed in the knife handle is extended to an end proximate to the knife handle, and another end of the resilient element is fixed to another end proximate to the knife handle, and an end of the knife body is pivotally coupled to an end of the knife handle, such that the knife body can be turned into or out of the knife handle along a pivotal position, and the brake portion is movably coupled to the pivotal position of the knife handle and the knife body, and a part of the brake portion is extended into a shock absorbing portion disposed on the knife body. If the knife body is folded completely into the knife handle, an end of the resilient element will press precisely on the periphery of the brake portion, such that the resilient element produces a torque to turn the brake portion into the knife handle. If the knife body is turned gradually out from the knife handle to drive the shock absorbing portion to turn in a predetermined shock absorbing angle and start driving the brake portion to turn, the resilient element will produce a torque to turn the knife body outward from the knife handle, and the knife body will be popped out automatically from the knife handle, so as to effectively prevent the knife body from being popped out accidentally by vibrations. The above and other objects, features and advantages of the present invention will become apparent from the following detailed description taken with the accompanying drawings.

DETAILED DESCRIPTION OF THE PREFERRED EMBODIMENTS

Figure 1:
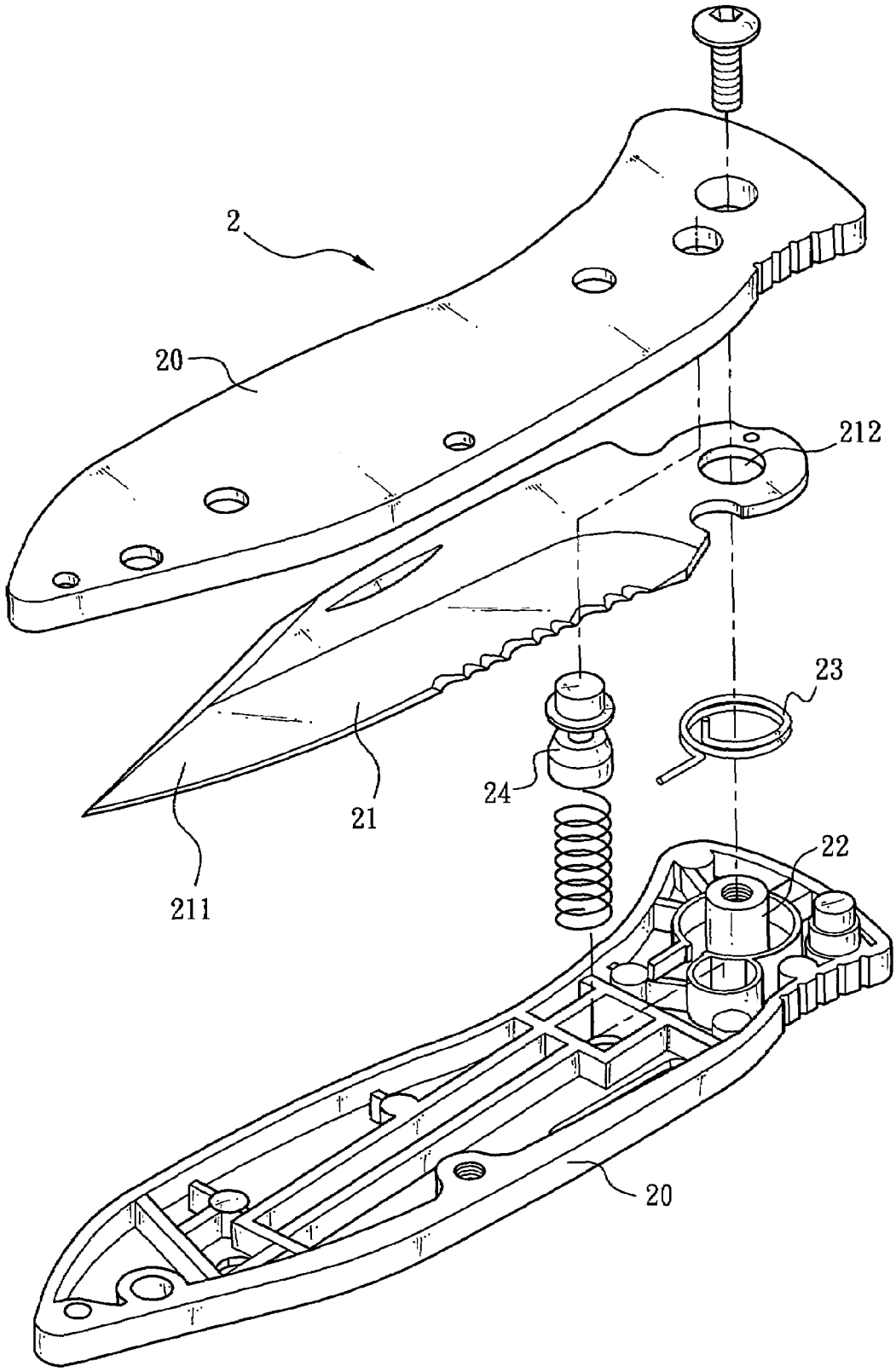
FIG. 1 (Prior Art)
FIG. 1 is an exploded view of a traditional automatic blade knife.

Referring to FIGS. 2 to 5, a folding knife assembly of the invention comprises a knife handle 5, a knife body 6, and a brake portion 7, wherein the knife handle 5 has a resilient element 51, and an end of the resilient element 51 is extended to an end proximate to the knife handle 5, and another end of the resilient element 51 is fixed proximate to another end of the knife handle 5. An end of the knife body 6 is pivotally coupled to an end of the knife handle 5, so that the knife body 6 can be turned into the knife handle 5 or out of the knife handle 5 along the pivotal position, and the brake portion 7 is movably disposed at a pivotal position of the knife handle 5 and the knife body 6, and a part of the brake portion 7 is extended to a shock absorbing portion 60 of the knife body 6. If the knife body 6 is folded completely into the knife handle 5, an end of the resilient element 51 will press precisely on the periphery of the brake portion 7, and an end of the resilient element 51 will produce a torque to turn the brake portion 7 into the knife handle 5. If the knife body 6 is turned gradually out of the knife handle 5 to drive the shock absorbing portion 60 to turn to a predetermined shock absorbing angle and start driving the brake portion 7 to turn, the resilient element 51 will produce a torque to turn the brake portion 7 out of the knife handle 5, and the knife body 6 will be popped out from the knife handle 5 automatically, so as to effectively prevent the knife body 6 popping out from the knife handle 5 and causing accidents when the knife body 6 is triggered unintentionally.

Figure 2:
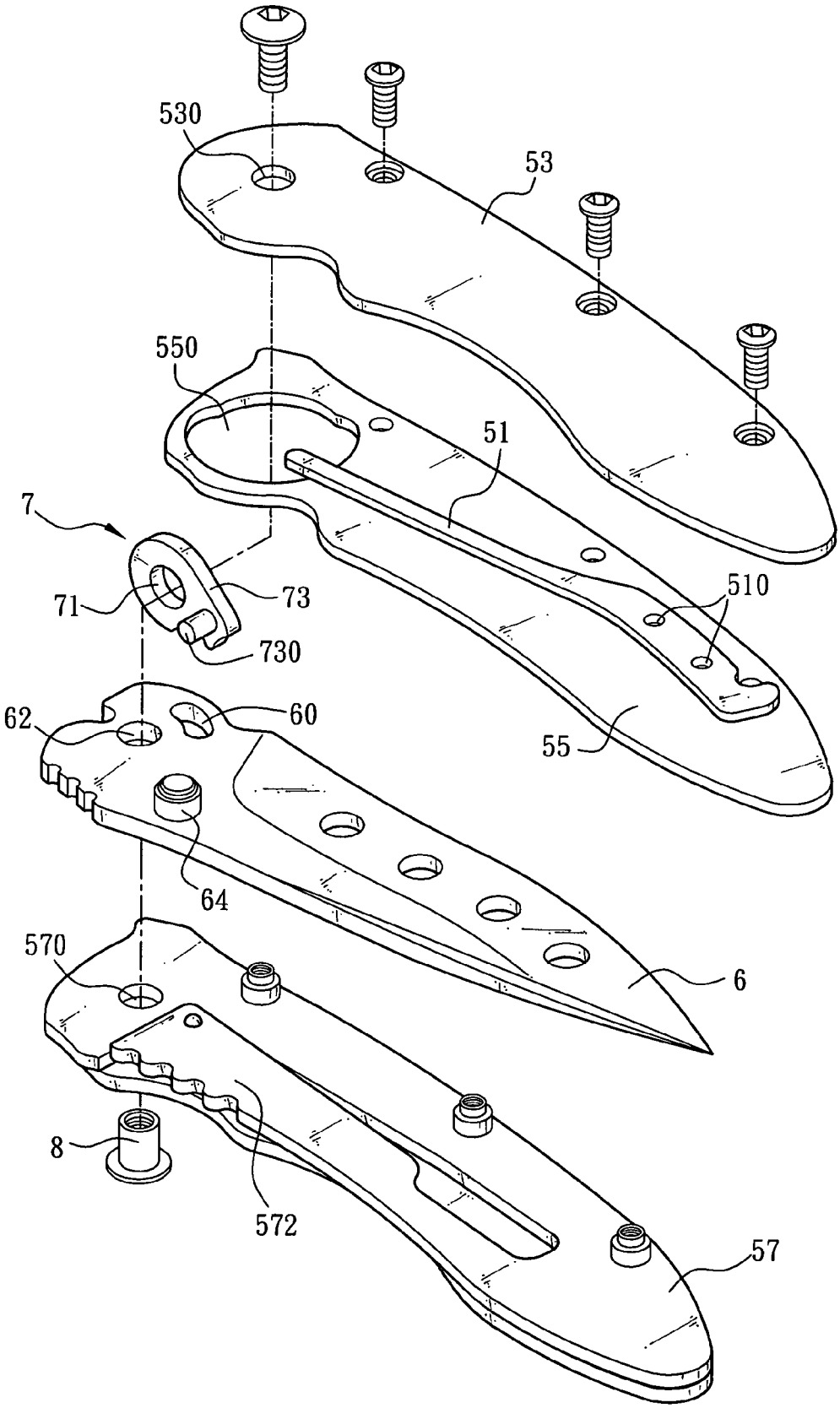
FIG. 2 is an exploded view of a folding knife assembly of the present invention.
Figure 3:
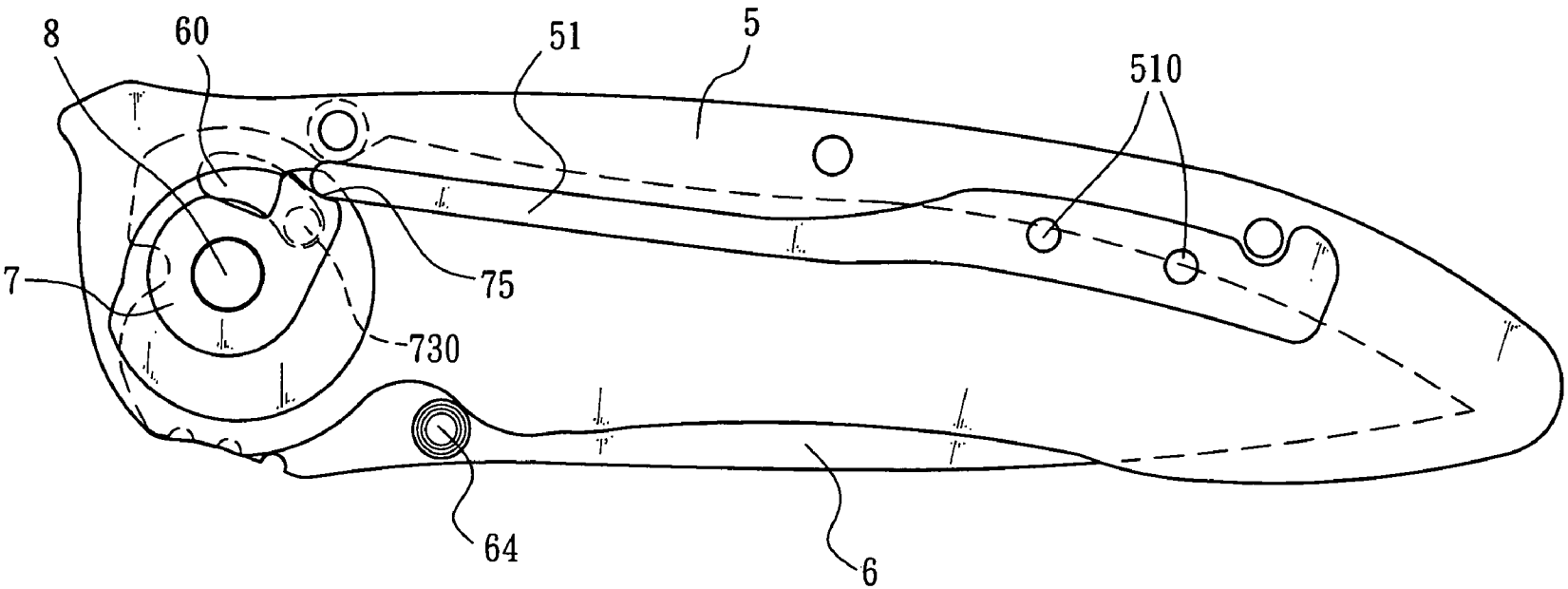
FIG. 3 is a schematic view of a folding knife assembly in a folded state according to the present invention.
Figure 4:
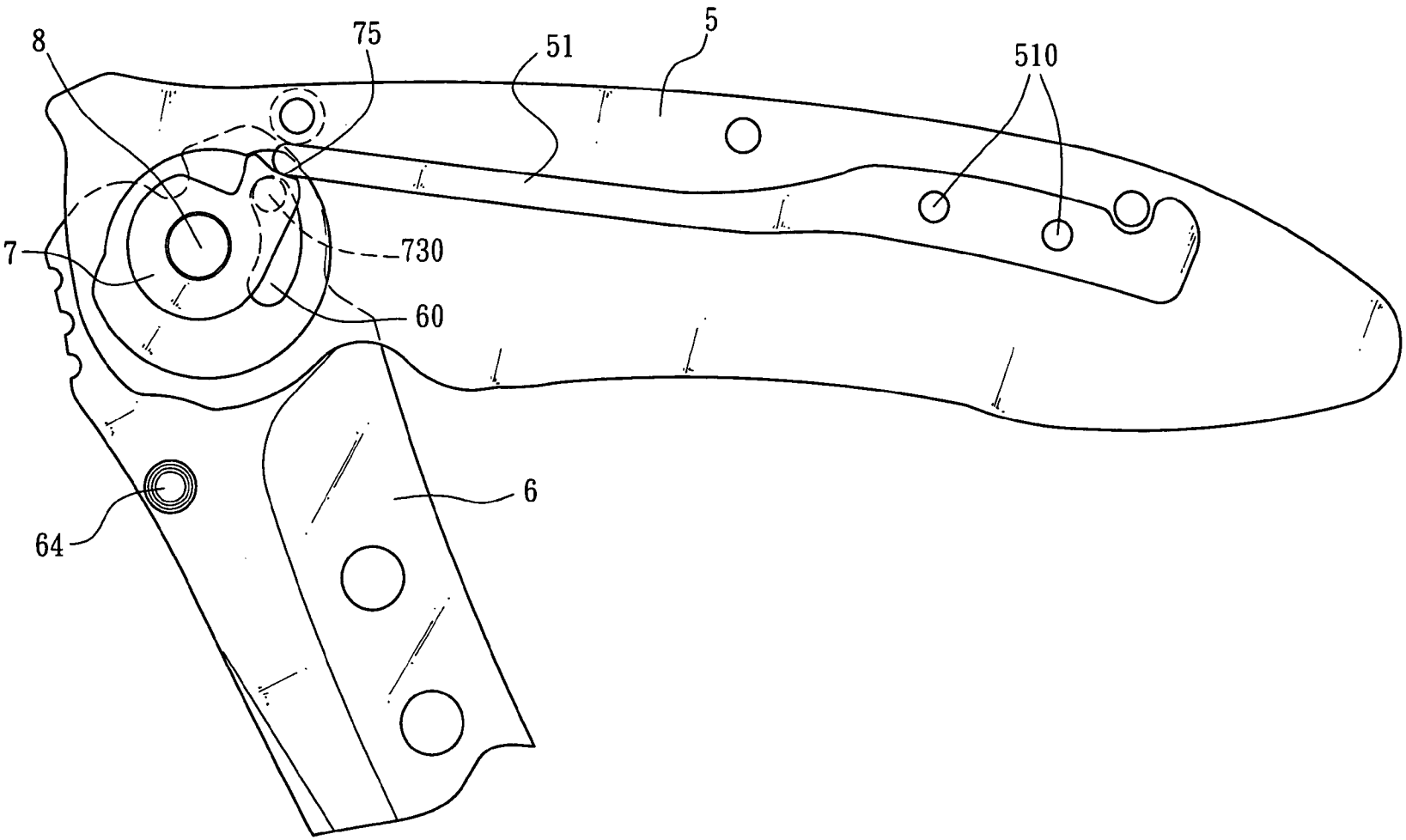
FIG. 4 is a schematic view of a folding knife assembly in a flip-open state according to the present invention.
Figure 5:
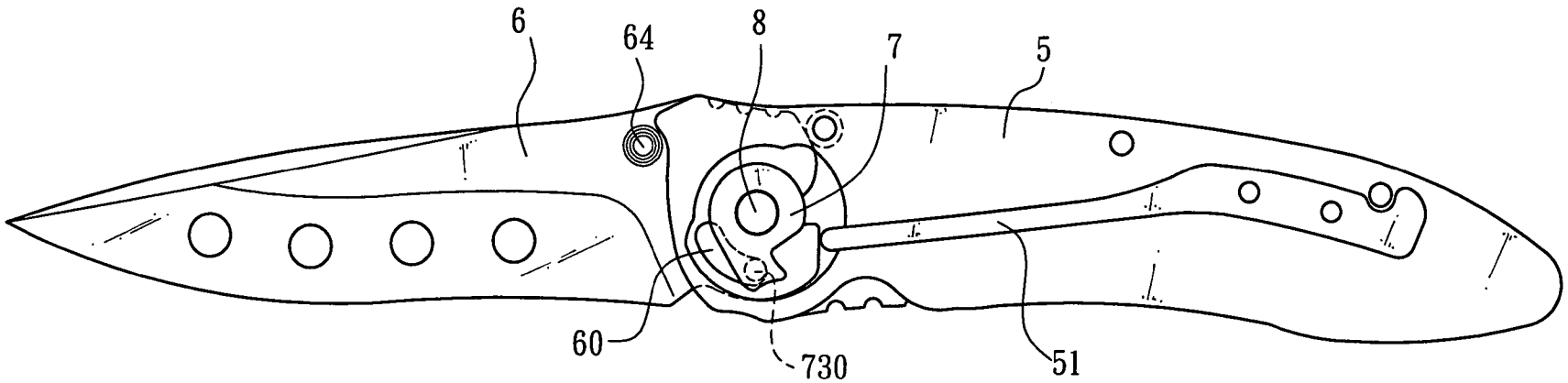
FIG. 5 is a schematic view of a folding knife assembly in a fully flip-open state according to the present invention.

Referring to FIG. 2 for the preferred embodiment of the present invention, the brake portion 7 comprises a first pivotal hole 71, a pressing member 73, and a protruding pillar 730, wherein the first pivotal hole 71 is disposed on the brake portion 7 for pivotally coupling the brake portion 7 between a surface of the knife body 6 and the knife handle 5, and an end of the pressing member 73 is disposed at the periphery of the brake portion 7 and another end is extended out of the brake portion 7. If the knife body 6 is folded completely into the knife handle 5, another end of the pressing member 73 will be pressed by an end of the resilient element 51, and the pressing member 73 will form a pressing point 75 with the resilient element 51 as shown in FIG. 3, and the pressing point 75 is disposed between a side of the knife handle 5 opposite to the side where the knife body 6 is turned out and the pivotal position. The resilient element 51 will produce a torque to the brake portion 7 to turn the knife body 6 into the knife handle 5, and an end of a protruding pillar 730 is disposed on a side of the pressing member 73 and facing the knife body 6, and another end is extended into the shock absorbing portion 60. If the knife body 6 is turned gradually out of the knife handle 5 to drive the shock absorbing portion 60 to turn to a predetermined shock absorbing angle, the protruding pillar 730 will start pushing the shock absorbing portion 60 and the brake portion 7 will turn with the knife body 6, and the contact point will start moving to another side of the knife body 6. If the contact point is moved to a position between another side of the knife body 6 and the pivotal position as shown in FIG. 4, the resilient element 51 will produce a torque to the brake portion 7 to turn the knife body 6 out of the knife handle 5, and the knife body 6 will pop out from the knife handle 5 automatically.

In FIG. 2, the shock absorbing portion 60 of a preferred embodiment is disposed on the knife body 6 and proximate to the pivotal position, and the shock absorbing portion 60 substantially in an arc shape can rotate by using the pivotal position as the axle center and the shock absorbing portion 60 is provided for extending the protruding pillar 730, such that the protruding pillar 730 can slide between both ends of the shock absorbing portion 60. If the knife body 6 is folded completely into the knife handle 5, the protruding pillar 730 will be extended to an end of the shock absorbing portion 60 as shown in FIG. 3. If the knife body 6 is turned gradually out of the knife handle 5 and another end of the shock absorbing portion 60 gradually approaches the protruding pillar 730 until the shock absorbing portion 60 is turned to a predetermined shock absorbing angle, the protruding pillar 730 will press against another end of the shock absorbing portion 60, and the brake portion 7 will start turning with the knife body 6 as shown in FIG. 4.

Figure 6:
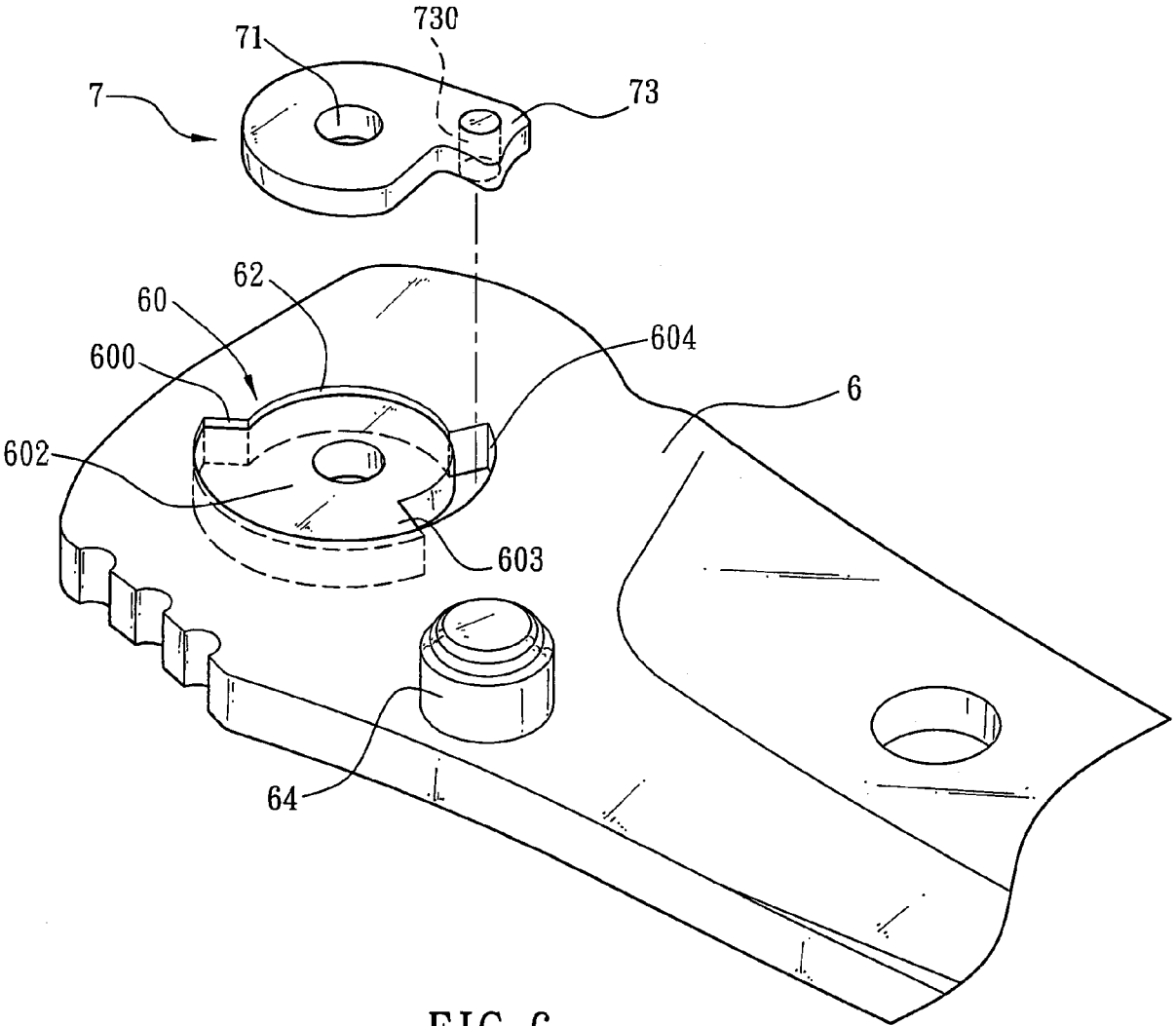
FIG. 6 is a schematic view of another preferred embodiment of the present invention.

Referring to FIG. 6 for another preferred embodiment of the present invention, the shock absorbing portion 60 is set in a second pivotal hole 62 disposed proximate to an end of the knife body 6, and the shock absorbing portion 60 comprises a matching member 600 and a turntable 602, wherein the matching member 600 is protruded from an internal wall of the second pivotal hole 62, and the turntable 602 is pivotally coupled into the second pivotal hole 606, and a part of the periphery of the turntable 602 has a protruding member 603, and an end of the protruding member 603 is coupled to an end of the matching member 600, and a shock absorbing space 604 is defined between another end of the protruding member 603 and another end of the matching member 600 for extending the protruding pillar 730 therein, so that the protruding pillar 730 can slide in the shock absorbing space 604. If the knife body 6 is folded completely into the knife handle 5, the protruding pillar 730 will be extended to an end of the shock absorbing space 604. If the knife body 6 is turned gradually out of the knife handle 5 and another end of the shock absorbing space 604 gradually approaches the protruding pillar 730 until the shock absorbing portion 60 is turned to a predetermined shock absorbing angle, the protruding pillar 730 will press against another end of the shock absorbing space 604, and the brake portion 7 will start turning with the knife body 6.

Figure 7:
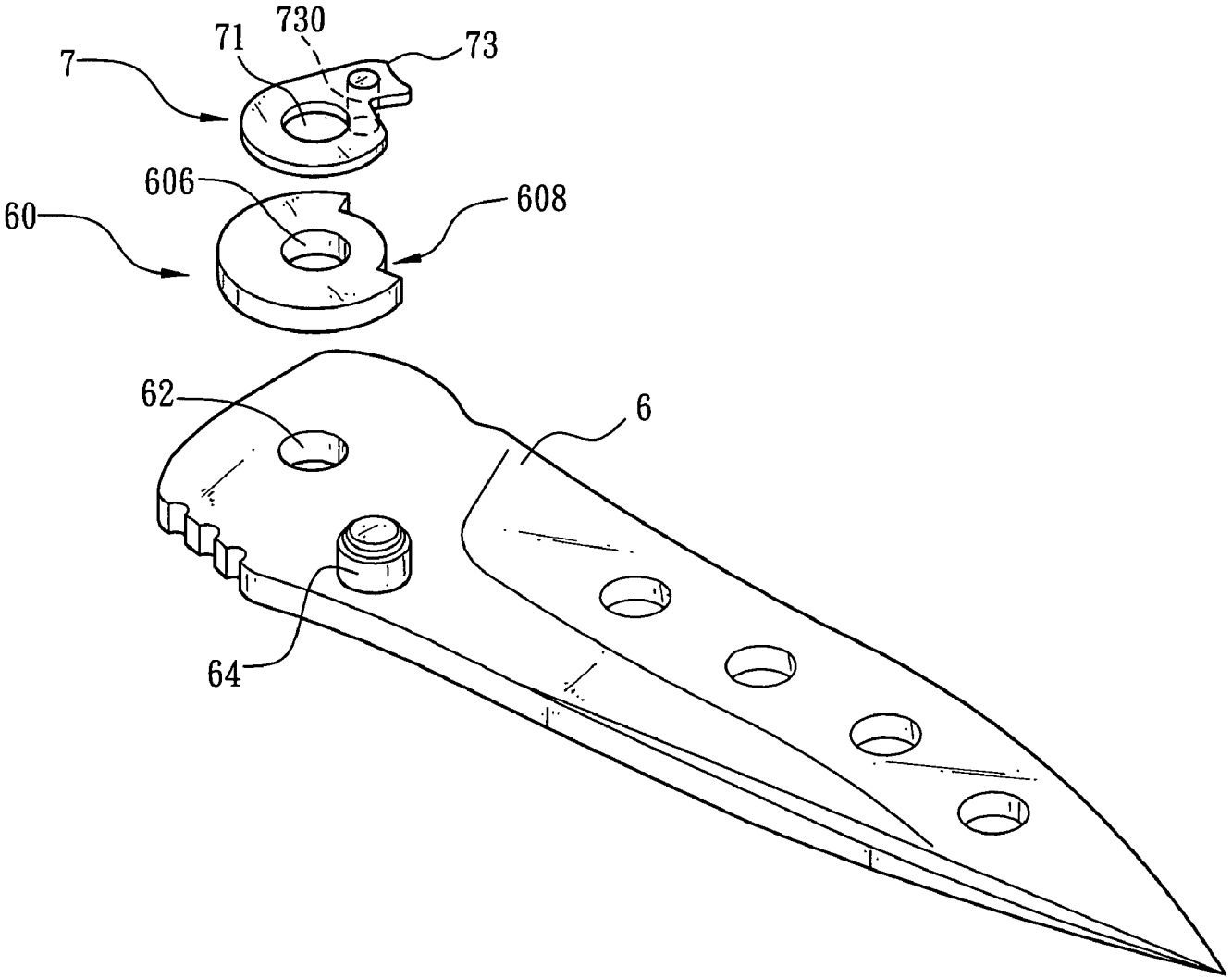
FIG. 7 is a schematic view of a further preferred embodiment of the present invention.

Referring to FIG. 7 for another preferred embodiment of the present invention, the shock absorbing portion 60 is fixed at the periphery of the second pivotal hole 62 and the shock absorbing portion 60 includes a third pivotal hole 606 and an indent 608, wherein the third pivotal hole 606 is disposed at the middle of the shock absorbing portion 60 for pivotally connecting the knife body 6 onto the pivotal position, and the indent 608 is disposed at the periphery of the shock absorbing portion 60 and provided for the protruding pillar 730 to be extended therein, such that the protruding pillar 730 can slide between both ends of the indent 608. If the knife body 6 is folded completely into the knife handle 5, the protruding pillar 730 will be extended to another end of the indent 608. If the knife body 6 is turned gradually out of the knife handle 5 and another end of the indent 608 gradually approaches the protruding pillar 730 until the shock absorbing portion 60 is turned to a predetermined shock absorbing angle, the protruding pillar 730 will press on another end of the indent 608, and the brake portion 7 will start turning with the knife body.

Referring to FIG. 2, the knife handle 5 of the foregoing embodiment comprises a first plank body 53, a partition 55, and a second plank body 57, wherein the first plank body 53 faces a surface of the knife body 6, and the first plank body 53 includes a first penetrating hole 530 disposed proximate to an end of the first plank body 53 for passing a pivotal shaft 8, and the partition 55 is installed between the first plank body 53 and the knife body 6. The partition 55 includes an accommodating ring 550 disposed proximate to an end of the partition 55 for passing the pivotal shaft 8 and provided for sliding the brake portion 7 in the accommodating ring 550, and the second plank body 57 faces another surface of the knife body 6, and the second plank body 57 has a second penetrating hole 570 disposed proximate to an end of the second plank body 57 for passing the pivotal shaft 8. Thus, an end of the knife body 6 is pivotally coupled to an end of the first plank body 53 and provided for accommodating the knife body 6 between the partition 55 and the second plank body 57.

In FIG. 2, the resilient element 51 of the preferred embodiment is disposed on a surface of the partition 55 that faces the first plank body 53, and the resilient element 51 has two fixing elements 510 disposed proximate to an end of the resilient element 51, such that the two fixing elements 510 can fix another end of the resilient element 51 to another end proximate to the partition 55, and an end of the resilient element 51 is extended into the accommodating ring 550 to press a pressing member 73 of the brake portion 7.

In FIG. 2, the second plank body 57 of the preferred embodiment includes a stopping element 572 faces a surface of the knife body 6, and an end of the stopping element 572 is fixed proximate to another end of the second plank body 57, and another end of the stopping element 572 is extended to a position proximate to the second penetrating hole 570 and resiliently bent towards the knife body 6. If the knife body 6 is turned completely out from the containing space, the stopping element 572 will press precisely on a distal edge of the knife body 6 to prevent the knife body 6 from shaking freely or cutting users accidentally. If a force is applied to another end of the stopping element 572 to produce a deformation towards the second plank body 57, the mutual pressing condition between the stopping element and the knife body 6 will be released, so that the knife body 6 can be accommodated into the knife handle 5.

In FIG. 2, the knife body 6 further includes a poking rod 64 disposed on a surface facing the partition 55 and proximate to the pivotal holes 62, 71, so that a user can hold the knife handle 5 by one hand and use an index finger or a thumb to push the poking rod 64, so as to turn the knife body 6 gradually out from the knife handle 5.

In summation of the description above, the components, shape, and design of the folding knife assembly can achieve the following objectives and effects:

1. With the operation of the brake portion 7 and the shock absorbing portion 60, the present invention can prevent the knife body 6 popping out from the knife handle 5 accidentally by a slight unintentional force and effectively avoid accidents, when the folding knife is placed in a user's pocket. The invention can comply with the requirements of safety regulations.

2. After the knife body 6 is turned out of the knife handle 5 completely, the stopping element 572 will press a distal edge of the knife body 6, and such arrangement not only improves the convenience of using the folding knife, but also prevents the knife body 6 from popping out or hurting users accidentally.

While the invention herein disclosed has been described by means of specific embodiments, numerous modifications and variations could be made thereto by those skilled in the art without departing from the scope and spirit of the invention set forth in the claims.

What is claimed is:

1. A folding knife assembly, comprising:

a knife handle, including a resilient element disposed therein, and a first end of said resilient element being extended proximate to a first end of said knife handle, and a second end of said resilient element being fixed proximate to a second end of said knife handle;

a knife body, with a first end pivotally coupled to the first end of said knife handle, such that said knife body can be turned into or out of said knife handle along a pivotal position; and a brake portion, movably disposed at a pivotal position of said knife handle and said knife body, and a part of said brake portion being extended into a shock absorbing portion on said knife body, such that when said knife body is folded completely into said knife handle, the periphery of said brake portion will be pressed precisely by the first end of said resilient element, and the first end of said resilient element will produce a torque to turn said brake portion into said knife handle; and when said knife body is turned gradually out from said knife handle to drive said shock absorbing portion to turn to a predetermined shock absorbing angle and start driving said brake portion to turn, the first end of said resilient element will produce a torque to said brake portion to turn said knife body out from said knife handle, so as to pop said knife body out of said knife handle automatically.

2. The folding knife assembly of claim 1, wherein said brake portion comprises:

a first pivotal hole, disposed on said brake portion for pivotally coupling said brake potion between a surface of said knife body and said knife handle;

a pressing member, with a first end disposed on the periphery of said brake potion and a second end extended out of said brake potion, such that when said knife body is folded completely into said knife handle, and the second end of said pressing member being pressed by the first end of said resilient element, and said pressing member forming a pressing point with said resilient element, and said pressing point being situated between a side of said knife handle opposite to where said knife body is turned out and said pivotal position, then said resilient element will produce a torque to turn said knife body into said knife handle; and a protruding pillar, with a first end disposed on a surface of said pressing member and facing said knife body, and a second end extended into said shock absorbing portion, such that when said knife body is turned gradually out of said knife handle to drive said shock absorbing potion to turn to a predetermined shock absorbing angle and start driving said brake portion to turn, and said pressing point moves to a position between another side of said knife body and said pivotal position, then said resilient element will produce a torque to said brake portion to turn said knife body out from said knife handle.

3. The folding knife assembly of claim 2, wherein said brake portion is disposed at said pivotal position proximate to said knife body, and said shock absorbing portion is substantially in an arc shape and uses said pivotal position as an axle center for extending said protruding pillar therein and said protruding pillar slides between both ends of said shock absorbing portion.

4. The folding knife assembly of claim 3, wherein said knife handle comprises:

a first plank body, facing a first surface of said knife body and having a first penetrating hole disposed proximately to a first end of said first plank body for passing a pivotal shaft;

a partition, installed between said first plank body and said knife body and having an accommodating ring disposed proximate to a first end of said partition for passing said pivotal shaft and provided for said brake portion to slide in said accommodating ring; and a second plank body, facing a second surface of said knife body and having a second penetrating hole disposed proximate to a first end of said second plank body for passing said pivotal shaft.

5. The folding knife assembly of claim 4, wherein said resilient element is disposed on said partition facing a first surface of said first plank body and includes two fixing elements disposed proximate to the second end of said resilient element, and said two fixing elements are disposed at the second end of said resilient element and proximate to a second end of said partition, and the first end of said resilient element is extended to said accommodating ring to press the pressing member of said brake portion.

6. The folding knife assembly of claim 5, wherein said second plank body includes a stopping element disposed on a surface facing said knife body, and a first end of said stopping element is fixed to a second end of said second plank body, and a second end of said stopping element is extended to a position proximate to said second penetrating hole and resiliently bent towards said knife body, such that when said knife body is turned completely out from said knife handle, said stopping element will press precisely on a distal edge of said knife body, and when a force is applied to the second end of said stopping element to produce a deformation towards said second plank body, the mutual pressing condition between said stopping element and said knife body will be released.

7. The folding knife assembly of claim 2, wherein said shock absorbing portion comprises a second pivotal hole proximate to the first end of said knife body, the shock absorbing portion further comprising:

a matching member, protruded from an internal wall of said second pivotal hole;

a turntable, pivotally coupled into said second pivotal hole, and having a protruding member disposed at a portion of the periphery of said turntable, and a first end of said protruding member being coupled to a first end of said matching member and a shock absorbing space formed between a second end of said protruding member and a second end of said matching member for said protruding pillar to be extended therein and provided for said protruding pillar to slide between both ends of said shock absorbing space.

8. The folding knife assembly of claim 7, wherein said knife handle comprises:

a first plank body, disposed on a surface facing said knife body and having a first penetrating hole disposed proximate to a first end of said first plank body for passing a pivotal shaft; a partition, installed between said first plank body and said knife body, and having an accommodating ring disposed proximate to a first end of said partition for passing said pivotal shaft and provided for said brake portion to slide in said accommodating ring; and a second plank body, facing another surface of said knife body, and having a second penetrating hole disposed proximate to a first end of said second plank body for passing said pivotal shaft.

9. The folding knife assembly of claim 8, wherein said resilient element is installed on a surface of said partition facing said first plank body and includes two fixing elements disposed proximate to the second end of said resilient element for fixing said resilient element to a second end of said partition, and the first end of said resilient element is extended to said accommodating ring to press the pressing member of said brake portion.

10. The folding knife assembly of claim 9, wherein said second plank body includes a stopping element disposed on a surface facing said knife body, and a first end of said stopping element is fixed proximate to a second end of said second plank body, and a second end of said stopping element is extended to a position proximate to said second penetrating hole and resiliently bent towards said knife body, such that when said knife body is turned completely out from said knife handle, said stopping element will press precisely on a distal edge of said knife body, and when a force is applied to the second end of said stopping element to produce a deformation towards said second plank body, the mutual pressing condition between said stopping element and said knife body will be released.

11. The folding knife assembly of claim 2, wherein said shock absorbing portion disposed around a second pivotal hole at the first end of said knife body comprises:

a third pivotal hole, disposed at the middle of said shock absorbing portion for pivotally coupling said knife body onto said pivotal position;

an indent, disposed at the periphery of said shock absorbing portion for extending said protruding pillar therein and provided for said protruding pillar to slide between both ends of said indent.

12. The folding knife assembly of claim 11, wherein said knife handle comprises:

a first plank body, disposed on a surface facing said knife body and having a first penetrating hole disposed proximate to a first end of said first plank body for passing a pivotal shaft;

a partition, installed between said first plank body and said knife body, and having an accommodating ring disposed proximate to a first end of said partition for passing said pivotal shaft and provided for said brake portion to slide in said accommodating ring; and a second plank body, facing another surface of said knife body and having a second penetrating hole disposed proximate to a first end of said second plank body for passing said pivotal shaft.

13. The folding knife assembly of claim 12, wherein said resilient element is installed on said partition facing a surface of said first plank body and having two fixing elements disposed proximate to the second end of said resilient element for fixing said resilient element to a second end of said partition, and the first end of said resilient element is extended to said accommodating ring to press the pressing member of said brake portion.

14. The folding knife assembly of claim 13, wherein said second plank body includes a stopping element facing a surface of said knife body, and a first end of said stopping element is fixed proximate to a second end of said second plank body, and a second end of said stopping element is extended to a position proximate to said second penetrating hole and resiliently bent towards said knife body, such that when said knife body is turned completely out from said knife handle, said stopping element will press precisely on a distal edge of said knife body, and when a force is applied to the second end of said stopping element to produce a deformation towards said second plank body, the mutual pressing condition between said stopping element and said knife body will be released.

* * * * *